US009734653B2

(12) United States Patent
Hughson

(10) Patent No.: US 9,734,653 B2
(45) Date of Patent: Aug. 15, 2017

(54) APPARATUS AND METHOD OF PROVIDING AN ELONGATED COIN SOUVENIR

(71) Applicant: Alexander William Hughson, Arroyo Grande, CA (US)

(72) Inventor: Alexander William Hughson, Arroyo Grande, CA (US)

( * ) Notice: Subject to any disclaimer, the term of this patent is extended or adjusted under 35 U.S.C. 154(b) by 396 days.

(21) Appl. No.: 14/640,230

(22) Filed: Mar. 6, 2015

(65) Prior Publication Data

US 2016/0140792 A1 May 19, 2016

Related U.S. Application Data

(60) Provisional application No. 62/079,030, filed on Nov. 13, 2014.

(51) Int. Cl.
*G07F 11/70* (2006.01)
*B21H 7/00* (2006.01)

(52) U.S. Cl.
CPC ..... *G07F 11/70* (2013.01); *B21H 7/00* (2013.01)

(58) Field of Classification Search
CPC ..... G07F 11/70; B21H 7/00; B21H 9/00
See application file for complete search history.

(56) References Cited

U.S. PATENT DOCUMENTS 5,950,475 A * 9/1999 Penny ..... B21H 9/00 72/197
6,055,839 A 5/2000 Hughson
6,389,862 B1 * 5/2002 Kusters ..... B02C 18/142 241/235
6,983,635 B2 * 1/2006 Rockholt ..... B44B 5/024 100/176
2003/0050815 A1 3/2003 Seigel et al.
2010/0268792 A1 10/2010 Butler et al.

FOREIGN PATENT DOCUMENTS

WO 2006117797 A1 11/2006

OTHER PUBLICATIONS

Feeney. "A Smashingly Popular Souvenir; Under Pressure, a Plain Old Penny Can Become Something to Remember." The Washington Post [Washington, D.C.] May 17, 2009.

* cited by examiner

*Primary Examiner* — Christopher Harmon
(74) *Attorney, Agent, or Firm* — Ariel S. Bentolila Bay Area IP, LLC

(57) ABSTRACT

An apparatus and method for providing one or more elongated coin souvenirs in a single payment transaction embossed with any or all available images. A user interface displays the available images and instructions on how to operate the apparatus. Once a user makes a selection and completes a payment transaction, the apparatus begins to press and emboss coins with chosen image or images. If multiple elongated coins are purchased, an electronic control system causes a delivery of a first coin and causes a pressing mechanism to elongate and emboss the first image onto the coin. Upon completion of this action, a delivery of a second coin to the pressing mechanism is impressed with the next image. These steps are then be repeated until all of the images purchased by the user are impressed onto coins and delivered to the user.

20 Claims, 3 Drawing Sheets

APPARATUS AND METHOD OF PROVIDING AN ELONGATED COIN SOUVENIR

CROSS-REFERENCE TO RELATED APPLICATIONS

The present Utility patent application claims priority benefit of the U.S. provisional application for patent Ser. No. 61/975,080, entitled "A METHOD TO INCREASE THE NUMBER OF AVAILABLE IMAGES ON AN ELONGATED COIN PRESSING MACHINE AND TO AUTOMATICALLY PRESS A COMPLETE SET OF IMAGES WITH A SINGLE PAYMENT " filed 4 Apr. 2014, and provisional application for patent Ser. No. 62/079,030 entitled "A METHOD TO INCREASE THE NUMBER OF AVAILABLE IMAGES ON AN ELONGATED COIN PRESSING MACHINE AND TO AUTOMATICALLY PRESS A COMPLETE SET OF IMAGES WITH A SINGLE PAYMENT" filed 13 Nov. 2014, under 35 U.S.C. 119(e). The contents of these related provisional applications are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to vending machines. More particularly, the invention relates to a device and method to increase the number of available images from an elongated coin pressing machine and to enable multiple coins to be purchased with a single payment.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Elongated coin pressing machines typically press a coin or token between two rollers to flatten and elongate the coin or token. One or both of the rollers may be engraved with images that may be stamped onto the coin or token as the coin or token is rolled and pressed between the rollers. These machines can be powered by an electric motor or may be manually operated by means of a crank or other lever system. Elongated coins and tokens are often purchased or collected as souvenirs.

By way of educational background, an aspect of the prior art generally useful to be aware of is that the number of images available from an elongated coin pressing machine may be limited by the number of images which can be engraved on the circumference of a die roller or carrier in the machine. It is believed that the die roller or carrier in currently available elongated coin pressing machines can typically be engraved with between one and four images. Additionally, one may expect that increasing the number of images available from the machine may result in a selection process that may be difficult to implement. Furthermore, current elongated coin pressing machines are usually only able to receive a fixed payment that may allow a user to select one image from those available on that particular machine. The machine may then press a coin or token with the chosen image and deliver the single elongated coin or token to the user. Therefore, each image typically must be separately and individually purchased, which may be time consuming. It is believed that the inconvenience of paying for each image separately may lessen the possibility that a user will purchase multiple images, which may result in less revenue generated by the machine.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic front view of the machine, and FIG. 1B is a diagrammatic front view of an exemplary pressing mechanism.

Figure 1A:
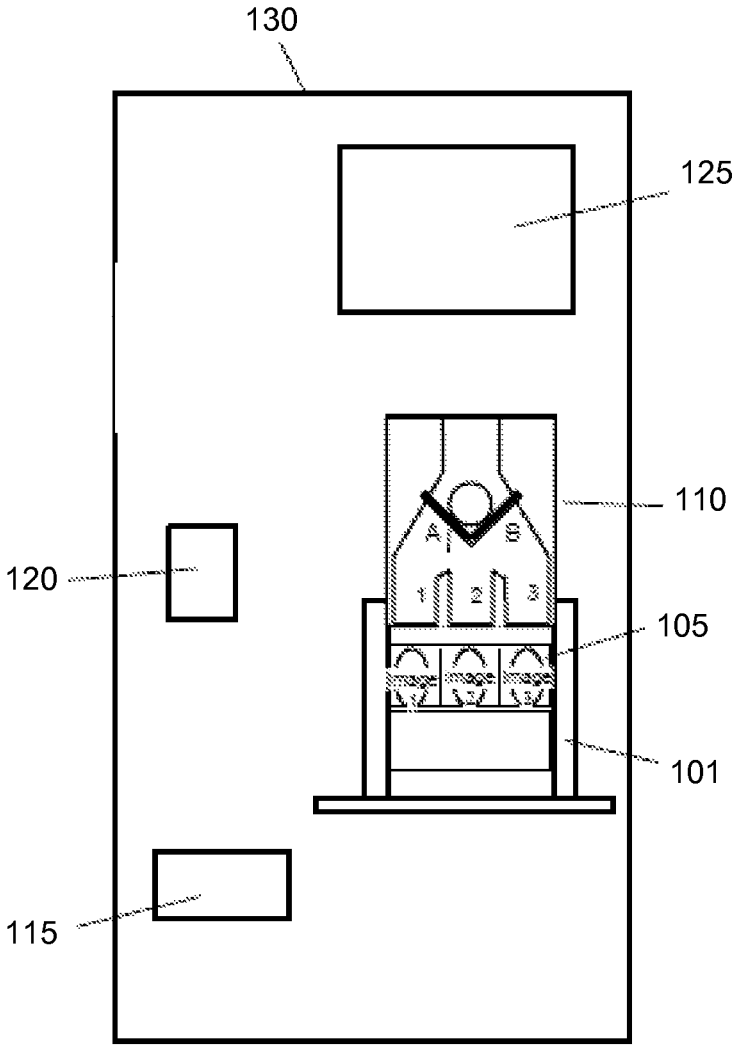
FIGS. 1A and 1B illustrate an exemplary elongated coin pressing machine that may enable a user to purchase multiple coins with a single payment, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub combination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(is), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an elongated coin pressing machine comprising means to increase the number of available images and to enable multiple coins to be pressed with a single payment. One embodiment may enable the elongated coin pressing machine to offer twelve different images and may comprise a regulating system to typically ensure that the correct image(s) are imprinted onto the coins or tokens. Some embodiments may enable a user to pay a certain price for and receive only one elongated coin or token bearing their choice of image, to pay a certain price for and receive more than one elongated coin or token bearing their choices of images, or to pay a certain price and receive coins or tokens bearing a complete set of images available from that particular elongated coin pressing machine. When multiple images are purchased in this embodiment, the coins or tokens may be delivered in a continuous stream without any required action on the part of the user. By allowing multiple coins or tokens to be purchased with a single payment, this embodiment may enable the machine to offer a discount for a purchase of multiple images, which may increase the likelihood that the user will purchase more coins or tokens and may increase the revenue collected by the machine.

Figure 1B:
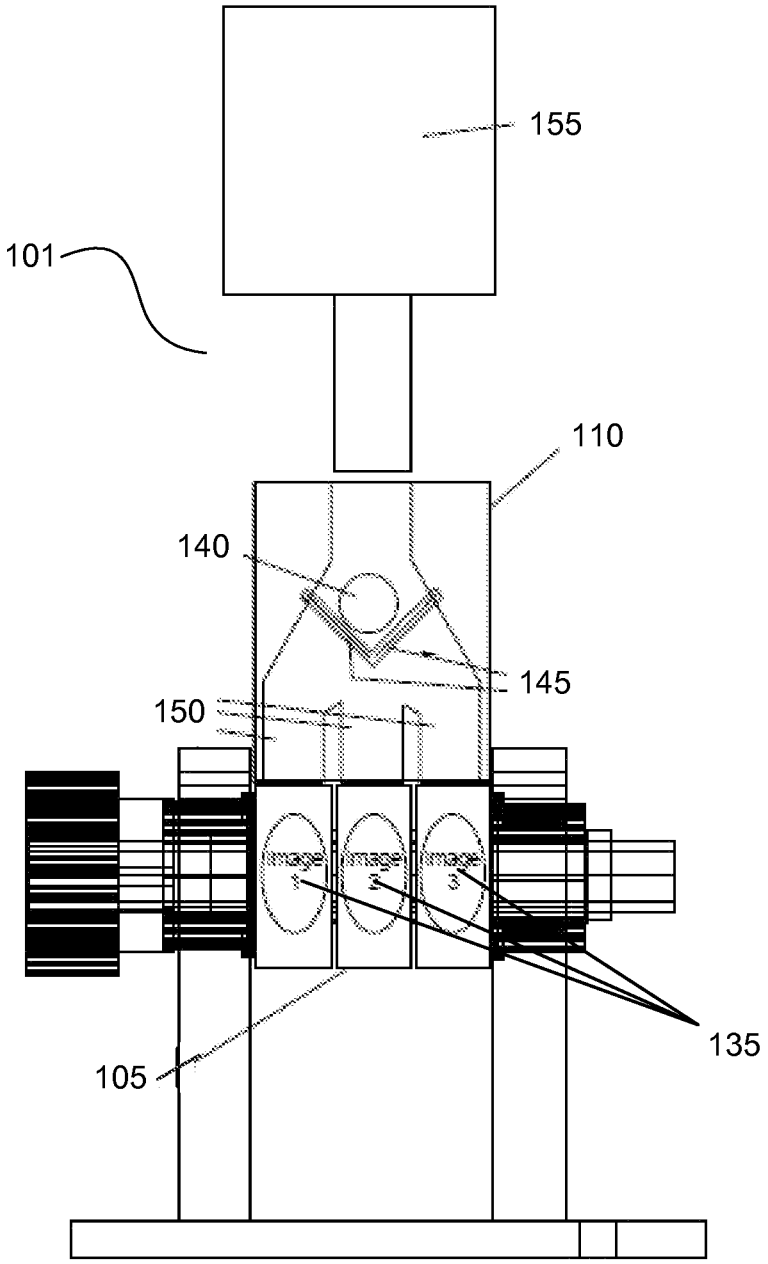

FIGS. 1A and 1B illustrate an exemplary elongated coin pressing machine that may enable a user to purchase multiple coins with a single payment, in accordance with an embodiment of the present invention. FIG. 1A is a diagrammatic front view of the machine, and FIG. 1B is a diagrammatic front view of an exemplary pressing mechanism 101. It is contemplated that some elongated coin pressing machines may be implemented for pressing items other than coins such as, but not limited to, tokens or blanks. Herein, the use of the word "coin" when referring to an item being pressed in a machine according to an embodiment of the present embodiment should be understood as referring to any suitable item that may be pressed by the machine unless the context clearly necessitates otherwise. In the present embodiment, the elongated coin pressing machine comprises pressing mechanism 101 with a multiple die carrier 105 and a regulator 110, an electronic control system 115, a payment accepting apparatus 120, and a user interface 125. These components may be arranged together in a secure housing 130 so that each element is mechanically and/or electronically connected with each other as necessary. For example, without limitation, electronic control system 115 may have the capability of starting and stopping pressing mechanism 101 and of synchronizing the timing and placement of the release of the coin or token to typically ensure a full and correct impression of the image on the coin or token. In addition, electronic control system 115 may send and receive signals to and from user interface 125, which may enable users to make the various selections necessary in the course of using elongated coin pressing machine 101. Electronic control system 115 may also send and receive signals to and from payment accepting apparatus 120 to help ensure that the proper payments are made and acted upon. In some embodiments software may be written to be executed by electronic control system 115 which may enable the various components to interact properly. Those skilled in the art will readily recognize, in light of and in accordance with the teachings of the present invention, that a multiplicity of suitable devices may be used in electronic control system 115 including, but not limited to, a dedicated logic board or circuit board, a microprocessor controlled device, a programmable logic controller (PLC). In one variation a computer may perform the control functions. In another variation the control functions may be performed by an array of electro-mechanical relays arranged to logically control the operation from start to finish.

Referring to FIG. 1B, pressing mechanism 101 comprises multiple engraved roller dies 135, each typically engraved with multiple images, on multiple die carrier 105 so that two or more "arrays" of images may be created thus increasing the number of images available for printing compared to current elongated coin pressing machines. For example, without limitation, the present embodiment may comprise four images on each of three roller dies 135 for a total of twelve available images, in compared to current pressing machines that may have three to four images total. In some embodiments an extra wide die roller engraved with more than one array of images may be used rather than multiple roller dies. In the present embodiment, pressing mechanism 101 may enable a coin 140 to enter between roller dies 135 and a smooth roller, not shown, which is adjacent to roller dies 135. As roller dies 135 and the smooth roller rotate in opposite directions, coin 140 typically passes through the small space between roller dies 135 and the smooth roller. The pressure on coin 140 from the rollers typically causes coin 140 to be elongated and impressed with an image from one of roller dies 135. In some alternate embodiments, the second roller may be engraved with one or more images so that elongated coins may be pressed with images on both sides. It is contemplated that in some embodiments, the pressing mechanism may be powered by an electrical motor, and in other embodiments the pressing mechanism may be powered by a hand operated crank or other manual means. In some embodiments in which the pressing mechanism is powered by electricity and automatic, the same Programmable Logic Controller (PLC) may be used to control the pressing mechanism and the electronic control system 115.

Some currently available elongated coin pressing machines with a single array of images use mechanical or electronic timing systems that help to ensure that a coin or token is released onto the die rollers at the correct time. Since the present embodiment comprises multiple arrays of images, pressing mechanism 101 comprises regulator 110 that may control the side to side alignment of coin 140 as well as the timing of the release of coin 140, to help ensure that coin 140 is delivered to the correct image at the correct time. Regulator 110 may comprise an electromechanical timing mechanism controlled by electronic means, which may be electronic control system 115 or separate electronic means. The side to side alignment of coin 140 may be achieved by means of a pin or paddle system of deflectors 145 in conjunction with a series of guidance channels 150 that may restrain and guide coin 140. In the present embodiment, if left deflector 145 is retracted, coin 140 typically falls via left channel 150 onto the left image on die roller 105. If right deflector 145 is retracted, coin 140 typically falls via right channel 150 onto the right image on die roller 105. If both deflectors 145 are retracted at the same time, coin 140 typically falls via center channel 150 onto the middle image on die roller 105. It is contemplated that various different approaches may be used in some embodiments to control the side to side alignment of the coin such as, but not limited to, shuttle systems, diverters and channels in different configurations, channels comprising movable coverings that may open or block individual channels, etc. Furthermore, embodiments comprising more or fewer arrays of images may comprise more or fewer diverters and channels in a multiplicity of suitable arrangements.

In the present embodiment, user interface 125 may be placed on housing 130 in a location that is convenient for users to view and operate. In some embodiments, user interface 125 may be a touch screen monitor that may display various screen shots for operation instructions, payment options, image options, etc. These embodiments may also incorporate a control system for the touch screen interface which, in conjunction with a computer or programmable logic controller, may allow for management of the selection process. Furthermore, instructions in multiple languages can be available on the touch screen and may be selected by the user in their preferred language, which may make the operation of the machine equipment clearer to the user. In other embodiments user interface 125 may comprise a series of mechanical or electro-mechanical switches or buttons with graphic instructions, which may or may not be available in multiple languages.

Referring to FIG. 1A, payment accepting apparatus 120 may also be mounted on housing 130 in a user friendly location for example, without limitation, on the front facing panel. Payment accepting apparatus 120 may comprise a coin acceptor, a bill acceptor, a credit/debit card acceptor, an RFID/NFC sensor, a token acceptor, or any combination of these and other payment accepting means. Some embodiments may require users to supply the coin or token to be pressed. In these embodiments an accepting apparatus for the coin or token to be pressed may be included in the payment accepting apparatus or could be configured as a separate apparatus. In the present embodiment users are not required to provide a coin or token for pressing. This may enable a user to make a purchase from elongated coin pressing machine 101 with a cashless transaction. Therefore, payment accepting apparatus 120 in these embodiments may be used only for payment and may comprise no means for the user to insert their own coin or token to be pressed. Referring to FIG. 1B, a coin or token hopper 155, may be attached to pressing mechanism 101 to supply the coin or token to be pressed. Electronic control system 115 may send and receive signals to and from coin hopper 155 to help ensure that hopper 155 typically delivers coin 140 to regulator 110 at the appropriate time to be correctly pressed. Some embodiments may give users a choice of supplying their own coin or token to be pressed or receiving a coin or token supplied by the machine. These embodiments may comprise both a coin hopper and means for users to supply a coin or token as part of the payment accepting apparatus or as a separate apparatus.

In typical use of the present embodiment, a user may be able to purchase, in a single payment transaction, one elongated coin, more than one elongated coin, or a set of elongated coins with all of the available images. This may allow for the possibility for offering a discount for purchasing more than one elongated coin, which may result in more revenue produced by the elongated coin pressing machine.

When the user walks up to the elongated coin pressing machine, user interface 125, which may be a touch screen or buttons and/or switches accompanied by words and pictures, displays instructions on how to operate the machine. If user interface 125 is a touch screen, the instructions may be displayed in a language selected by the user from multiple selections. Once the user makes their selections and completes the payment transaction, the machine begins to press coins or tokens with the chosen image or images. If the user selects to purchase only a single elongated coin, electronic control system 115 may cause hopper 155 to deliver coin 140 to regulator 110 and cause pressing mechanism 101 to start up and to impress the chosen image onto coin 140. If the user chooses to purchase multiple elongated coins, which may or may not each bear a different image, electronic control system 115 may cause coin hopper 155 to deliver a first coin 140 to regulator 110 and may cause pressing mechanism 101 to start up and press the first image onto coin 140. Immediately upon completion of this action electronic control system 115 may then cause coin hopper 155 to deliver a second coin to pressing mechanism 101 to be similarly elongated and impressed with the next image. These steps may then be repeated until all of the images purchased by the user are impressed onto coins and delivered to the user. In some embodiments not comprising a coin or token hopper, these steps may be executed in a similar fashion except that the user may be required to insert their own coins or tokens in sequence until the number of images purchased are pressed onto the supplied coins or tokens. Alternatively, in some embodiments without coin hoppers, the user may insert all of the coins or tokens to be pressed all at once at the beginning of the process, for example, without limitation, these coins or tokens may be inserted at the same time as the payment.

In some embodiments, elongated coin pressing machines without multiple or widened rollers to accommodate additional images may be configured to allow the user to buy multiple elongated coins with a single payment. Those skilled in the art will readily recognize, in light of and in accordance with the teachings of the present invention, that some alternate embodiments may be incorporated into various different types of vending machines such as, but not limited to, food and beverage machines, toy vending machines, jukeboxes, machines selling other types of collectables including, without limitation, stamps, stickers, postcards, etc.

Figure 2:
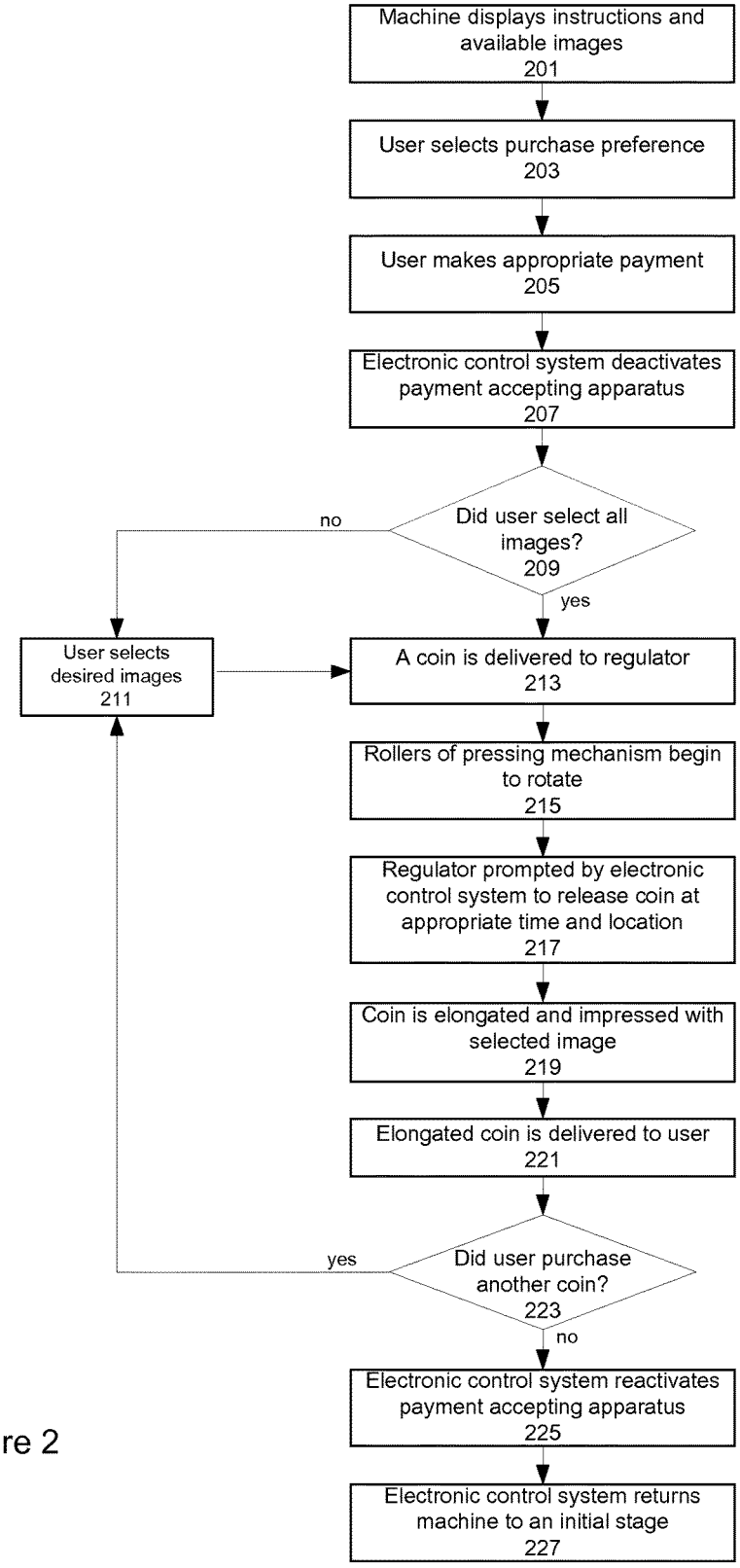
FIG. 2 is a flow chart illustrating an exemplary process for pressing elongated coins using an elongated coin pressing machine, in accordance with an embodiment of the present invention.

FIG. 2 is a flow chart illustrating an exemplary process for pressing elongated coins using an elongated coin pressing machine, in accordance with an embodiment of the present invention. In the present embodiment, in step 201, the machine displays instructions on a user interface, which may be shown in a language chosen by the user. The user interface may also display the images available to be impressed onto a coin thus creating an elongated coin souvenir. Typically, the user may be offered a choice of purchasing only one of the images, more than one image, or all of the images for different stated prices. In step 203, the user may indicate their purchase preference using the user interface. The user then makes the appropriate payment based upon their selection using a payment accepting apparatus in step 205. At this stage an electronic control system may deactivate the payment accepting apparatus so that multiple payments typically cannot be made in step 207. In step 209 it is determined if the user has chosen to purchase all of the images. If not, the user may select the desired image or images from the available images displayed on the user interface in step 211. If the user has opted to purchase a complete set of the images available, the selection of the desired images is typically not necessary as one of each image will be pressed, and this step may be skipped.

In step 213, a coin is delivered to a regulator portion of a pressing mechanism. This may be accomplished by the electronic control system, which may cause a coin hopper to deliver a coin or token to the regulator. In some applications the user may supply the coin to be pressed by placing their coin into a coin accepting mechanism, which may or may not be part of the payment accepting apparatus. Once the coin is accepted, chutes, channels or guides may direct the coin into the regulator. Then, the electronic control mechanism may cause the rollers of the pressing mechanism to begin to rotate, in step 215. In an elongated coin pressing machine that may be powered by human means, the user may turn a crank, wheel or other leveraged means to cause the rollers of the pressing mechanism to rotate.

In step 217 the electronic control system monitors the rotation of the roller die to determine when the roller die is rotationally in an appropriate position to typically enable the regulator release the coin at the proper time to reliably deliver the coin or token to the correct image. The electronic control system may also control the configuration of deflectors within the regulator, which, in conjunction with a series of guidance channels, may restrain and guide the coin to typically ensure that the coin is in the correct side to side position on the roller die. Then, the coin is driven through the rollers, and the pressure of the rollers elongates the coin and embosses the selected image onto the coin. In step 221 the elongated coin may be delivered to the user by an exit chute and delivery cup.

In step 223, the electronic control system determines if the user has purchased another elongated coin. If so the electronic control returns to step 211 to display the available images and prompt the user to choose the next desired image immediately upon completion of the pressing of the previous coin. In an alternate embodiment, the user may choose all of the images desired at the beginning of the process. In these embodiments, the electronic control may store these choices and press the coins consecutively without prompting the user to select a desired image immediately prior to the pressing process. In the present embodiment, once the user selects the desired image, the pressing process, steps 213 through 221, is repeated with the current coin. Once the elongated coin is delivered to the user, the electronic control system again determines if the user has purchased another coin in step 223. This loop may be repeated until all of the images purchased by the user have been imprinted and delivered. When the pressing of the coins is complete, a signal may be sent by a switch, sensor or other sensing means to the electronic control system indicating that the user's purchase has been fulfilled in step 225. Upon receipt of this completion signal, the electronic control system returns the machine to an initial stage in step 227 in which the payment accepting apparatus is again ready to receive payment for a new pressing sequence.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112 (6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing an elongated coin pressing machine that may enable multiple coins to be purchased with a single payment according to the present invention will be apparent to those skilled in the art. Various aspects of the invention have been described above by way of illustration, and the specific embodiments disclosed are not intended to limit the invention to the particular forms disclosed. The particular implementation of the elongated coin pressing machine may vary depending upon the particular context or application. By way of example, and not limitation, the pressing machines described in the foregoing were principally directed to metal embossing implementations; however, similar techniques may instead be applied to machines that may impress images on various different types of items and materials such as, but not limited to, cards and other paper or cardboard items, leather items including without limitation key fobs or bookmarks, wood veneer, or some plastics, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A method comprising the steps of:

displaying, on a user interface of a coin pressing machine, purchasing instructions and different images for selection, wherein a selected image is embossed on an elongated coin for creating an elongated coin souvenir, in which said displaying step further comprising offering a selection of said different images, and in which said different images comprising at least one image, at least two or more images or all of said displayed images for storage;

storing said selection of at least one image, at least two or more images or all of said displayed images for preparation of a purchasing preference;

accepting, by a payment accepting apparatus, said purchasing preference based on said image selection and said acceptance of said purchasing preference is configured to confirm said creation of at least one elongated coin souvenir;

deactivating said payment accepting apparatus, wherein said deactivating step is configured to stop additional or multiple purchases;

delivering, to a regulator portion of said coin pressing mechanism, at least one coin to be elongated and embossed with at least one selected image;

rotating at least one roller die, of said coin pressing machine, wherein said rotation of at least one roller die is configured to elongate said at least one coin for embossing;

monitoring, by an electronic control system, said rotation of at least one roller die, in which said monitoring step further comprising the step of determining when said roller die is rotationally in an appropriate position, wherein said regulator portion of said coin pressing machine is configured to generally release said elongated coin at a predetermined time and to prepare said elongated coin for embossing of said selected image;

embossing said selected image onto said elongated coin for delivery;

delivering said embossed elongated coin; and indicating said embossed elongated coin has been delivered.

2. The method of claim 1, further comprising the step of:

ascertaining whether additional images are selected and purchased, in which said ascertaining step further comprising the step of ascertaining whether additional coins are provided.

3. The method of claim 2, further comprising the step of:

repeating the step of delivering at least one coin to be elongated and embossed with said selected image or images all the way through said indicating step, in which additional images has been ascertained to be selected and purchased and additional coins are provided corresponding to the number of images selected and purchased.

4. The method of claim 3, wherein said repeating step is configured to be performed continuously based on the number of images selected and purchased.

5. The method of claim 2, further comprising the step of:

reactivating said payment accepting apparatus, wherein no additional image or coin has been ascertained to be selected and purchased.

6. The method of claim 5, further comprising the step of:

returning said coin pressing machine to said displaying step, wherein said displaying step is an initial stage of said coin pressing machine.

7. The method of claim 6, further comprising the step of:

indicating a completion and delivery of said selected and purchased image.

8. The method of claim 4, in which all available images are selected and purchased at a discounted price, wherein said discounted price is configured to entice a purchaser to purchase more coins and being operable to increase a revenue collected by said coin pressing machine.

9. The method of claim 2, further comprising the steps of:

selecting a desired image, in which additional coins has been ascertained to be selected and purchased, wherein said desired image selection step is performed continuously based on the number of coins selected and purchased and after each elongated and embossed coin has been delivered;

repeating the step of delivering at least one coin to be elongated and embossed with said selected image through said indicating step.

10. The method of claim 9, in which said stored images comprising at least two or more images, wherein said selection of desired images is performed continuously and automatically based on said stored at least two or more images.

11. An apparatus comprising:

means for displaying purchasing instructions and different images for selection, wherein a selected image is embossed on an elongated coin for creating an elongated coin souvenir;

means for offering a selection of a number of said different images for purchasing preference;

means for storing said selection of at least one image, at least two or more images or all of said displayed images;

means for accepting said purchasing preference based on said image selection;

means for deactivating said payment accepting apparatus, wherein said deactivating means is configured to stop additional or multiple payments;

means for determining a number of images selected and purchased;

means for delivering at least one coin to be elongated and embossed with at least one selected image;

means for elongating said at least one coin;

means for regulating said elongating means, wherein said regulating means control a side to side alignment of said at least one coin and the timing of a release of said coin;

means for rotating said elongating means, wherein said rotation of said elongating means is configured to elongate said at least one coin;

means for monitoring said rotation of said elongating means, in which said monitoring means determines when said elongating means is rotationally in an appropriate position, wherein said regulating means is configured to generally release said elongated coin at a predetermined time, to prepare said elongated coin for embossing of said selected image;

means for embossing said selected image onto said elongated coin;

means for delivering said embossed elongated coin to said purchaser; and means for indicating said embossed elongated coin has been delivered.

12. The apparatus of claim 11, further comprising a means for indicating a completion and delivery of said selected and purchased image.

13. The apparatus of claim 11, in which said means for elongating said at least one coin comprising multiple engraved elongating means.

14. The apparatus of claim 11, further comprising a means for housing said apparatus.

15. The apparatus of claim 11, further comprising a means for accepting a coin for embossing of said selected and purchased image.

16. The apparatus of claim 11, further comprising a means for controlling said regulating and monitoring means.

17. The apparatus of claim 11, in which said displaying means comprising a touch screen monitor.

18. A method comprising the steps of:

displaying, on a user interface of a coin pressing machine, purchasing instructions and different images for selection, wherein a selected image is embossed on an elongated coin for creating an elongated coin souvenir, in which said displaying step comprises offering a selection of at least one image, at least two or more images or all of said displayed images for purchasing preference at different prices and for storage;

storing said selection of at least one image, at least two or more images or all of said displayed images for preparation of a purchasing preference;

accepting, by a payment accepting apparatus, said purchasing preference based on said image selection and confirming said creation of at least one elongated coin souvenir;

deactivating said payment accepting apparatus, wherein said deactivating step is configured to stop additional or multiple purchases;

delivering, to a regulator portion of said coin pressing mechanism, at least one coin to be elongated and embossed with at least one selected image;

rotating at least one roller die, of said coin pressing machine, wherein said rotation of at least one roller die is configured to elongate said at least one coin;

monitoring, by an electronic control system portion, said rotation of at least one roller die, in which said monitoring step further comprising the step of determining when said roller die is rotationally in an appropriate position, wherein said regulator portion of said coin pressing machine is configured to generally release said elongated coin at a predetermined time and to prepare said elongated coin for embossing of said selected image;

embossing said selected image onto said elongated coin for delivery to a purchaser;

delivering said embossed elongated coin to said purchaser;

indicating said embossed elongated coin has been delivered;

determining whether additional images are selected and purchased, in which said determining step further comprising the step of ascertaining whether additional coins are provided which corresponds to the number of images selected and purchased; and repeating the step of delivering at least one coin to be elongated and embossed with said selected image or images, in which additional images has been ascertained to be selected and purchased and additional coins provided.

19. The method of claim 18, wherein said repeating step is configured to be performed continuously based on the number of images selected and purchased.

20. The method of claim 19, further comprising the steps of:

reactivating said payment accepting apparatus, wherein no additional image or coin has been determined to be selected and purchased;

returning said coin pressing machine to said displaying step, wherein said displaying step is an initial stage of said coin pressing machine.

* * * * *